United States Patent [19]

Le Molaire

[11] Patent Number: 4,629,093

[45] Date of Patent: Dec. 16, 1986

[54] PROPORTIONING DISPENSER FOR POWDERED PRODUCTS

[75] Inventor: Roger Le Molaire, Charpey, France

[73] Assignee: Societe a Responsabilite Limitee:Ateliers Durand et le Molaire Z.A., France

[21] Appl. No.: 637,753

[22] Filed: Aug. 6, 1984

[30] Foreign Application Priority Data

Sep. 13, 1983 [FR] France ..... 83 14734

[51] Int. Cl.[4] ..... B67D 5/32; B65D 88/54; G01F 11/10; G01F 11/00

[52] U.S. Cl. ..... 222/40; 222/252; 222/345; 222/357; 222/361; 222/367; 222/404; 86/31; 141/129; 141/250

[58] Field of Search ..... 222/344, 345, 349, 342, 222/369, 284, 289, 360, 369, 460, 462, 267, 266, 346, 356, 357, 55, 252, 254, 40, 354, 361; 86/31, 25, 24; 141/108, 109, 129, 250; 53/266 R

[56] References Cited

U.S. PATENT DOCUMENTS

| | | | |
|---|---|---|---|
| 899,640 | 9/1908 | Wangelin | 222/254 |
| 2,161,190 | 6/1939 | Paull | 222/252 |
| 3,091,368 | 5/1963 | Harley et al. | 222/254 X |
| 3,179,304 | 4/1965 | Heilbrunn | 222/267 |
| 4,340,096 | 7/1982 | Stoddard | 141/129 X |
| 4,407,380 | 10/1983 | Elder | 222/55 X |
| 4,431,070 | 2/1984 | Andrews | 222/55 X |

FOREIGN PATENT DOCUMENTS

| | | | |
|---|---|---|---|
| 431319 | 2/1948 | Italy | 222/369 |
| 13509 | of 1914 | United Kingdom | 222/369 |

*Primary Examiner*—H. Grant Skaggs
*Assistant Examiner*—Gregory L. Huson
*Attorney, Agent, or Firm*—Ostrolenk, Faber, Gerb & Soffen

[57] ABSTRACT

Proportioning dispenser for powdered products consisting of a main body delimitating a first, filling chamber and a second, discharge chamber. The body supports a feed hopper, a proportioner operable to move between the two chambers, and a dispenser located beneath the discharge chamber. The dispenser comprises a cup movable from a loading position under the discharge chamber to a position of automatic discharge. A preferred embodiment involving the filling of explosive cartridges is described.

20 Claims, 7 Drawing Figures

IV
IV
14a
16
17
19
20
II
14
22
21
13
18
32
15
23
26
27
12
2
28
34
31
30
f3
11
1
1a
1₁
33
7
29
6
37
f2
8
10
VII
9
VI
VI
56
VII
57
II
54
59
55
43
45
53
44
61
V
V
52
49
41
48
46
58
47
42
f4
4
3
5

PROPORTIONING DISPENSER FOR POWDERED PRODUCTS

BACKGROUND OF THE INVENTION

This invention relates to a device enabling the proportioning and dispensing, on a repetitive basis, of all types of powdered products to be packaged in a single or multi-constituent container.

More specifically, the invention is directed to a proportioning dispenser used to proportion and dispense powdered products as part of a packaging machine which itself operates on a repetitive automatic basis, in other words, designed to automatically fill a series of containers appearing sequentially at one or more filling stations in a large-scale process-type operation.

An even more specific focus of the invention is the technical field involving the loading of powders into hollow cylinders or shells to make explosive cartridges.

The type of loading just mentioned has been achieved in the past using a number of different devices, generally involving the principle of overfilling, consisting in discharging into the container a quantity of powder greater than the container's actual capacity. This operation is followed by a wiping off of the surplus product in order to limit the charge to a plane passing through the open top of the container.

A major drawback of this approach is that it leads to considerable pollution of the environment around the machine by the surplus powder which has been wiped off and which is difficult to fully recover by automatic means.

Attempts to deal with this problem in the prior art have involved proportioning the product in advance, particularly by using sliding compartment proportioning devices comprising one or more chambers each feeding a common receiver. The sliding compartment, or each sliding compartment, is moved relative to a template or gauge designed to equalize the load of useful volume and remove the surplus product. The loaded compartment is then discharged into the container.

Such a device cannot provide continuous service and consistent output because the product being proportioned is compressed when passing through the gauge which results in dose variations in a measured quantity or dose that are all the more significant for the smallness of the initial dose.

Moreover, forcing the filled slide into the gauge/template can result in rubbing and heating as well as compression of particles caught between the relatively sliding walls. This can create a fire or explosion in the case of processing inflammable or explosive powders.

Another disadvantage of the above-mentioned solution results from the fact that powdered products are frequently abrasive and cause wear of the slide valve and/or the template. Consequently, the proportioning action becomes unreliable over time, entailing serious repercussions, especially when one must fill a given volume with several powders requiring relatively precise proportioning.

Another prior art solution consists in providing a proportioning device based on filling a scoop by dipping it into a store of the products, then wiping off the surplus with a doctor blade applying against the upper edge of the scoop. This approach provides correct proportioning, but satisfactory dispensing of the products still must be accomplished.

All the design alternatives provided hereto entail the retention of an undetermined amount of powdered products on their walls. As a result, the loads actually dispensed deviate from the load initially required in a completely random manner, depending on whether the walls retain some of the particles from the dispensed loads or, on the other hand, suddenly deliver, as the result of a vibration or impact, all of the various particles that have built up on their walls over previous operating cycles.

A further disadvantage of the solutions offered to data stems from the fact that the devices provided fail to prevent the spreading of a fire resulting from a flaming up or sudden explosion at some point in the transfer chain. They thus constitute a serious hazard in terms of the propagation of a fire which could result in the firing or explosion of the main powder store.

BRIEF DESCRIPTION OF THE INVENTION

It it a primary object of this invention to obviate the various disadvantages mentioned above, by providing an improved proportioning dispenser able to work with all types of powdered products yet having reliability and safety features making it particularly suitable for the processing of inflammable or explosive powders.

It is another object of the invention to provide a proportioning dispenser so designed as to isolate from one another the various cells provided for storage, proportioning, dispensing and/or transfer purposes, such as to afford means operable, should the need arise to block the propagation of a fire or explosion accidentally occurring at any of the stages in the transfer of the powdered product being proportioned or otherwise processed.

It is still another object of the invention to provide a proportioning dispenser consisting of a compact unit which can be easily adapted or disassembled from a given station in a transfer line when required for the purpose of fitting the unit with a device the proportioning and delivery characteristics whereof more closely match the capacity of the container to be filled.

To achieve these objectives, the invention provides a proportioning dispenser for powdered products having a main attaching and supporting body delimitating a filling chamber and a discharge chamber, separated from one another by a ridge, said main body further supporting parts as follows:

- a hopper to supply powdered product to the filling chamber,
- a proportioner operable to move cyclically between the filling chamber where it picks up a load of powdered product and the discharge chamber whereinto it dumps said load,
- and a dispenser located beneath said discharge chamber and comprising a cup, said cup being operable to move cyclically from a loading position vertically in line with the discharge chamber to a position of automatic discharge.

DETAILED DESCRIPTION OF THE INVENTION

Other features of the invention will be apparent from the following description, with reference to the appended drawings showing one non-limiting embodiment of the invention, wherein:

FIGS. 5 and 6 are partial cross-sectional views taken along lines V—V and VI—VI, respectively, of FIG. 1;

Figure 1:
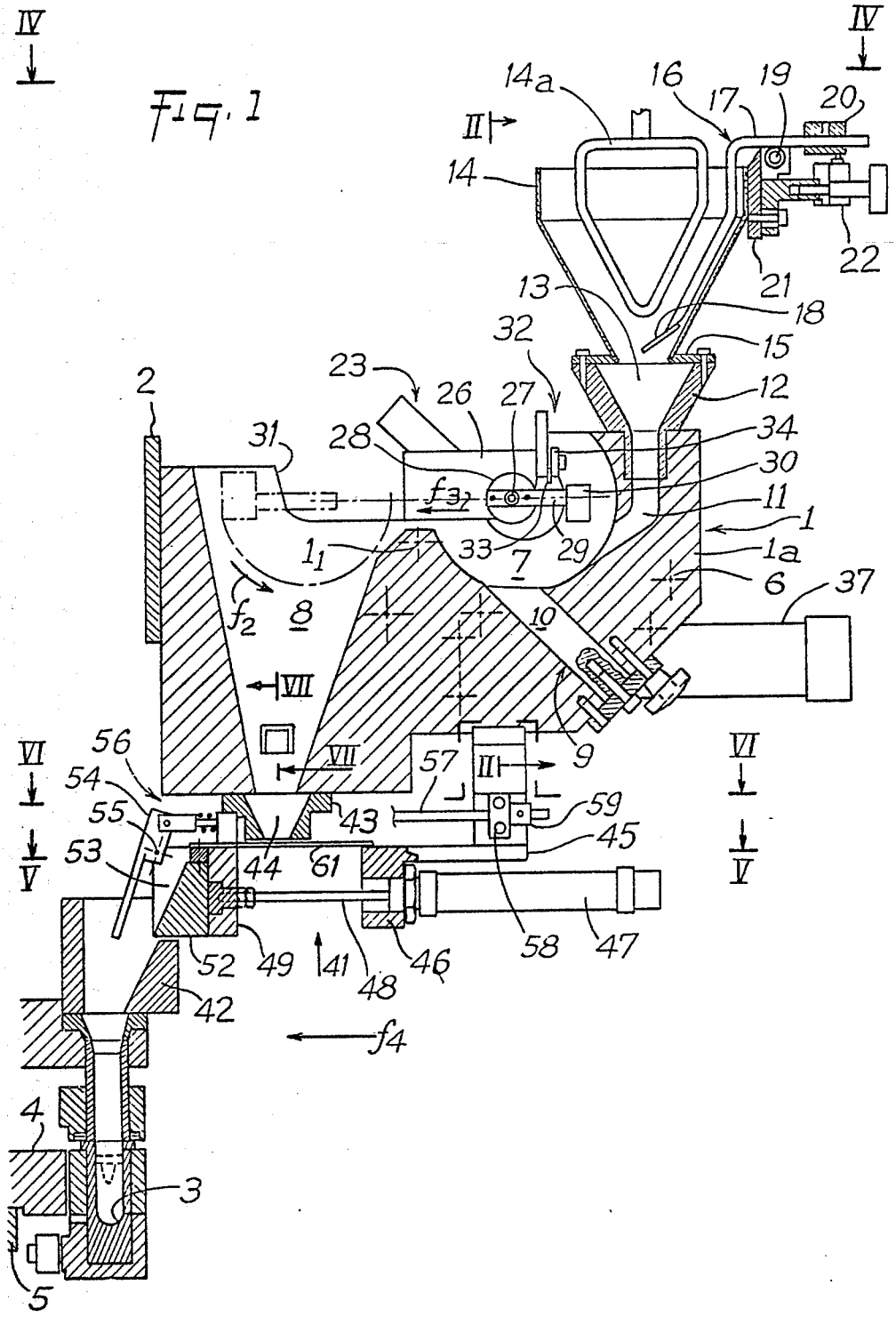
FIG. 1 is a cross-sectional elevation, partly broken away, of a proportioning dispenser according to the invention.
Figure 7:
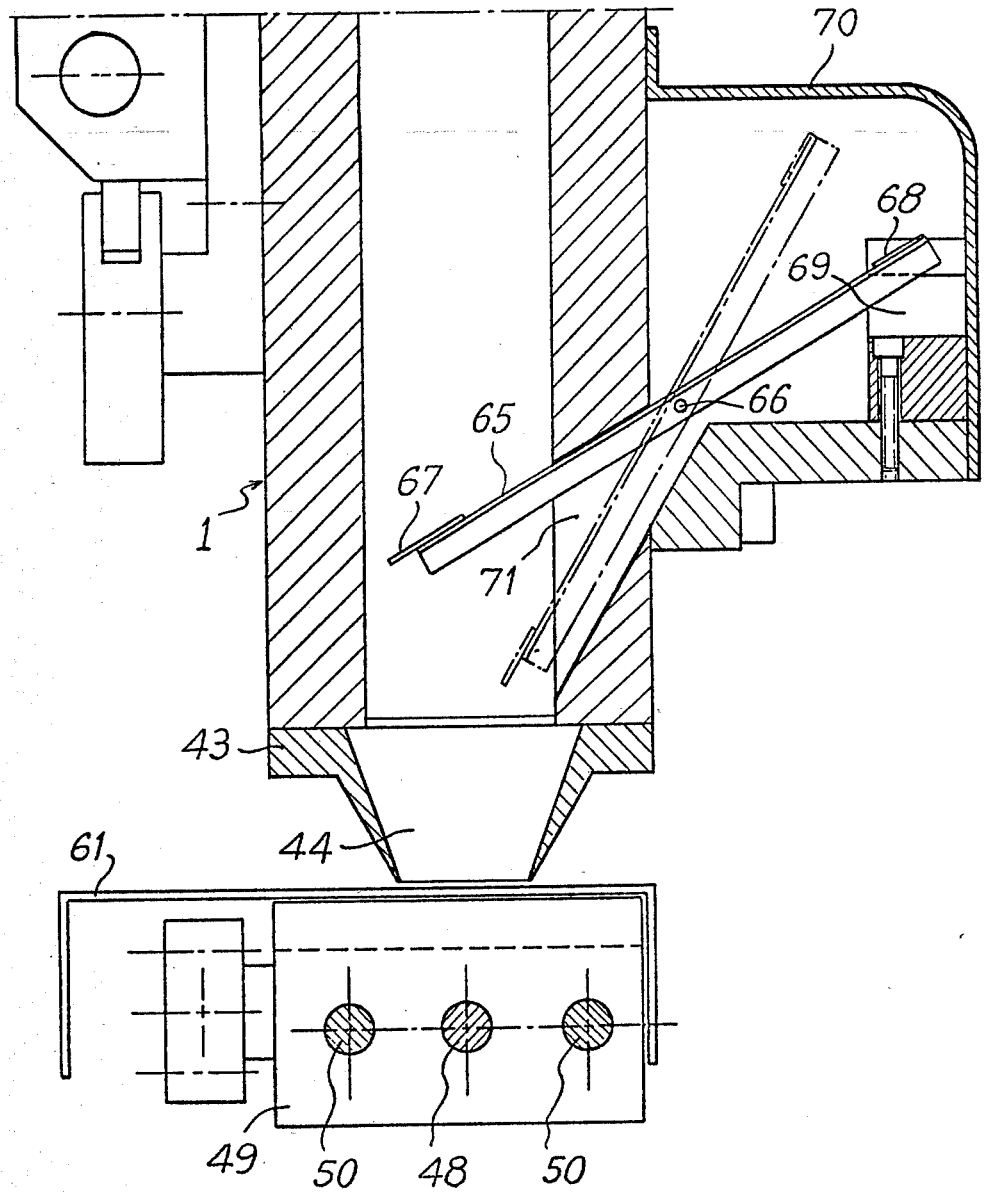

and FIG. 7 is a partial transverse cross sectional and enlarged view taken along line VII—VII of FIG. 1.

DETAILED DESCRIPTION OF THE INVENTION

As shown in the drawings, the proportioning dispenser according to the invention for powdered products consists of a main attaching and supporting body 1 designed to be fitted by any suitable means to the panel 2 of a work station designed to handle the packing, filling or loading of a container such as item 3.

What follows will be more readily understood with reference to FIG. 1, which shows one possible application of the invention wherein the container 3 is a cylinder or cartridge shell to be loaded with a charge of powdered product, whose subsequent final packaging involves the fitting of an interior percussion cap, not shown in the drawings, into the cylinder. The container 3 may be carried for example by a transfer device 4 being part of the moving element 5 of an automatic transfer machine.

The proportioning dispenser body 1 is preferably made up of two half-bodies 1*a* and 1*b* (FIG. 2) fitted together with screws 6. However, any other suitable type of construction could be used for main body 1, including integral molding or casting.

Figure 2:
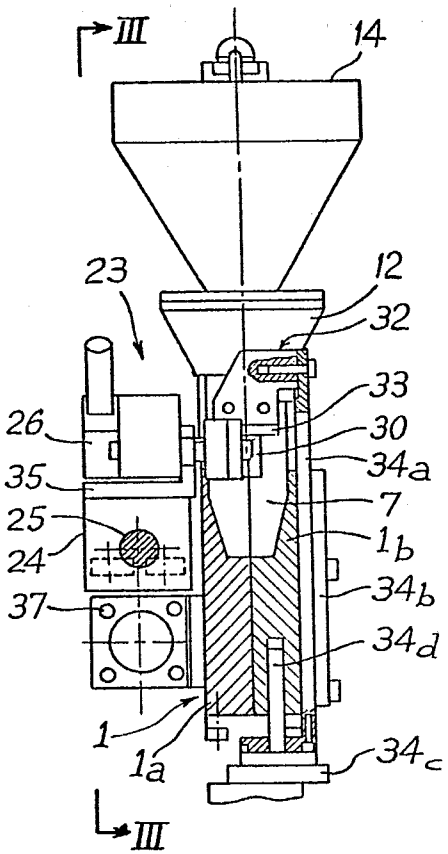
FIG. 2 is a partly cross-sectional transverse view taken along line II—II of FIG. 1.

In any case, the body 1 is constructed such as to delimit, within its open top surface, a filling chamber 7 and a discharge chamber 8. The filling chamber 7 is basically shaped in the form of a cylinder having a horizontal axis, with an axial tapering possibly provided, as shown in FIG. 2. The filling chamber 7 communicates with a drain pipe 9 provided between the bottom of the chamber 7 and the base of main body 1. The drain pipe 9 is plugged during operation of a plug 10.

The chamber 7 also communicates with a connecting pipe 11 tangentially rising from the chamber to the bottom end of a funnel seat 12 removably mounted on the top part of main body 1. The funnel seat 12 delimits a cavity 13 in the shape of a truncated cone, or inverted truncated pyramid, the small base of which is placed substantially in the plane of the open top edge. The funnel seat 12 is specifically provided as an adaptor for fitting on a hopper 14 serving to feed powdered product to filling chamber 7. The hopper 14 is provided with a neck flange 15 arranged in the plane of its small open base, the section of which is smaller, for reasons which will appear hereinafter, than that of the large base of cavity 13. The hopper 14 is associated with a level sensor 16 consisting of a rocker arm 17 supporting a pallet 18 in hopper 14. The rocker arm 17 is pivotably mounted on an articulation shaft 19 supported by the hopper 14 and extends beyond the shaft 19. It is provided with a balancing counter-weight 20. The shaft 19 is preferably carried by a support 21 provided on the hopper 14 and is designed to enable the installation of a switch 22 operable by the rocker arm 17, and more specifically in the present case, by the counterweight 20. Hopper 14 is moreover preferably provided with or associated with mixing means 14*a* the intermittent rotation of which serves to defeat any arching effects in the powder.

The discharge chamber 8 is given an overall inverted truncated pyramid shape. This chamber is delimited such as to form an alignment with chamber 7 perpendicular to the axis of chamber 7. Chamber 8 has steeply sloped, smooth walls providing an almost sheer vertical drop, for reasons that will be apparent from the following. The chambers 7 and 8 are thus separated from each other by a ridge $1_1$ arranged as part of the main body 1, the ridge rising above an imaginary horizontal plane passing through the bottom of the filling chamber 7.

The main body 1 supports a ladle-type rotary proportioner designated by the reference numeral 23. The rotary proportioner 23 includes a carriage 24, shown in FIGS. 3 and 4, mounted and guided, lockably against rotation, in a first slideway 25 attached to the outside of main body 1. Carriage 24 supports, on its top, a two-way rotary actuator 26, the rotational angle range of which can be limited. The output shaft 27 of the rotary actuator 26 has a hub 28 to which the arm 29 of a measuring ladle 30 can be removably fitted. The shaft 27 crosses a cutout space 31 in the corresponding wall of main body 1. The shaft 27 thus extends through chamber 7, preferably along the geometrical axis of the chamber 7, when in a stable stationary position corresponding to a filling condition, as illustrated in FIG. 1.

The arm 29 is mounted on shaft 27 such as to be preferably located in the center plane of chamber 7. The length of the arm 29 is sufficiency to ensure suitable clearance between the ladle 30 and the peripheral wall defining chamber 7.

The hub 28 and the rotary actuator 26 are chosen to be operable to hold the ladle 30, when said actuator 26 is in a stable stopping position, in a substantially vertical position under a wiper 32 supported by the main body 1 and extending therefrom into the chamber 7. The wiper 32 comprises a squeegee or blade 33 secured by a clamp 34 such as to present a horizontal lower edge facing the top, open section of the ladle 30.

The clamp 34 is attached to the top part of a rod 34*a* (FIG. 2) sliding on the outside of the main body 1, in a guideway 34*b*, the guideway 34*b* being operable to clamp and axially immobilize the rod 34*a*. Guideway 34*b* rests through its base on a control button 34*c* which extends in the form of a screw 34*d* screwed into the body 1.

After loosening the guideway 34*b*, the button 34*c* can be worked to change the vertical setting of the blade 33 and adjust its wiping action. The chosen setting is then stably and accurately maintained by tightening the guideway 34*b*.

The previously mentioned carriage 24 (FIGS. 2,3) is connected via an end plate 35 to the stem 36 of a jack 37 flange mounted on the body 1 by means of a flange 38 and moves on the outside of the body 1, parallel to slideway 25. The jack 37 is controlled by two adjustable limit switches 39 and 40 which determine the useful stroke of stem 36 and consequently the to and fro motion imposed on shaft 27. The stroke is determined in relation to the length of the cutout 31 provided in body 1 from chamber 7 to at least partly through discharge chamber 8.

The main body 1, at its bottom part, supports a reciprocating dispenser 41 serving to transfer product from the discharge chamber 8 to a filling funnel 42 attached either directly or indirectly to the main body 1 or its supporting member. The funnel 42 is preferably associated with a two-way vertical motion control enabling it to be brought to sealably rest on the top part of the container station 3. The dispenser 41 can be arranged in direct contact with the small base of chamber 8 or, instead, with the opening of a product transfer adaptor 43 attached to the bottom of body 1. Adaptor 43 defines a passge 44 shaped substantially as an inverted truncated cone, the passage 44 providing the transitional gravity flow of product between the discharge chamber 8 and the dispenser. Passage 44 is moreover provided with major base having a larger cross section than the minor, open bottom base of the discharge chamber 8.

Figure 5:
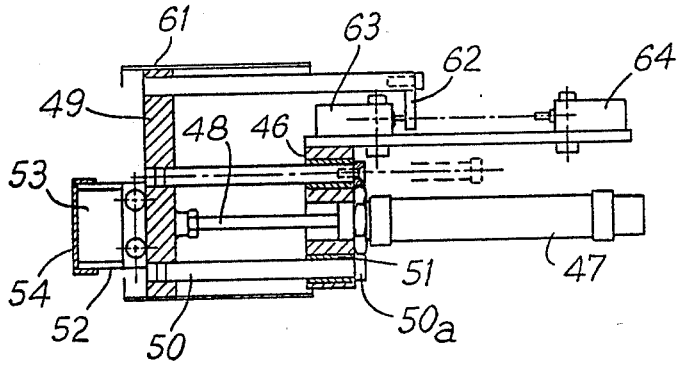
FIG. 5 is a top view taken along line IV—IV of FIG. 1.
Figure 6:
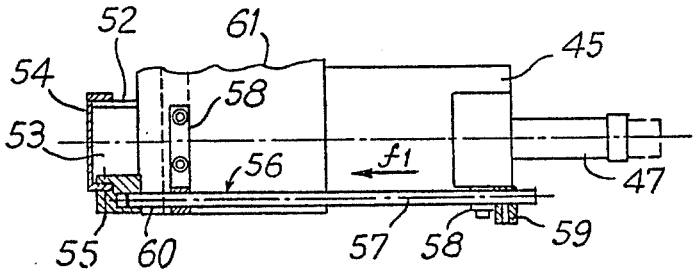

The dispenser 41 includes a bracket 45 which hangs from the bottom of body 1 and serves as a attaching part and guiding means for the moving constructional elements of the dispenser 41. For this purpose, the bracket 45 comprises a cross slide 46 (FIG. 5) supporting the end of a double-acting cylinder 47. The piston rod 48 of the cylinder 47 drives a slide 49, the slide 49 being guided by means of cylindrical rods 50 in bearing rings 51 built into slide 46. The ends of the guide rods 50 nearest the cylinder 47 are provided with stops 50*a* designed to cooperate with cross slide 46. The dispensing slide 49 carries a cup 52, opposite cylinder 47, providing a receiver 53 for the load of powdered product. The receiver 53 is bounded by two vertical walls, one oblique wall and one hinged shutter 54, the shutter 54 being the front wall of the cup, in terms of the direction of travel corresponding to the filling of a container 3. This shutter 54 is swivelable about a horizontal hinge pin 55 (FIG. 1) in the top of cup 52. The shutter 54 is moreover associated with an automatic opening and closing means 56, comprising, as shown in FIG. 6, a push rod 57 mounted in guide sleeves 58 respectively supported by the main body 1 and the bracket 45. The push rod 57 is associated with a backstop 59 designed to provide a positive opening control, as will be clear from the description of operation hereinafter. The push rod 57 is also associated with springy means 60, for example of the helical type spring, working in compression, sliped on the rod concentrically to a position between one of the guide sleeves 58 and, for example, an arresting boss on the rod.

The slide 49 comprises a cover 61 extending toward the bracket 45 such as to cover the cylindrical guide rods 50 and the piston rod 48 whenever the cup 52 is brought to a discharge position with respect to the transfer or filling funnel 42.

The operation of the above-described embodiment of the invention will now be described.

When at rest, at the beginning of an operating cycle, it may be assumed that the double-acting cylinder 47 has driven the cup 52 to a loading position whereby the receiver 53 is under and in line with the discharge chamber 8.

In this position, the backstop 59 is removed with respect to guide sleeve 58 such that the spring 60 pulls the push rod 57 in the direction of arrow $f_1$ (FIG. 6), causing the shutter 54 to swivel and close receiver 53.

Meanwhile, the jack 37 has been energized to extend piston stem 36 and bring carriage 24 into the position where the ladle 30 is aligned with the chamber 8. As illustrated with the broken line of FIG. 1, the rotary actuator 26 has also been energized so that, by rotation of the shaft 27, the open section of ladle 30 is directed toward the small base or outlet of the discharge chamber 8.

For the device to operate, the system must be suitably supplied with powdered product, introduced in the feed hopper 14, which ensures filling of filling chamber 7 by gravity, via the funnel seat 12 and the connecting pipe 11.

A full operating cycle of the proportioning dispenser according to the invention proceeds as follows:

The jack 37 is energized to retract stem 36, bringing carriage 24 to a position wherein the output shaft 27 of the rotoary actuator 26 coincides with the axis of chamber 7.

This position can be determined by limit switch 40, which can also control the subsequent operation, for example, of the rotary actuator 26 which, when energized, rotatively drives shaft 27 in the sense indicated by arrow $f_2$ in FIG. 1.

The ladle 30 is thus angularly driven through chamber 7, such as to be filled by the relative motion with respect to the product in chamber 7. Shaft 27 is rotatively driven by actuator 26 until the ladle 30 reaches the position illustrated by the solid outline in FIG. 1.

Figure 3:
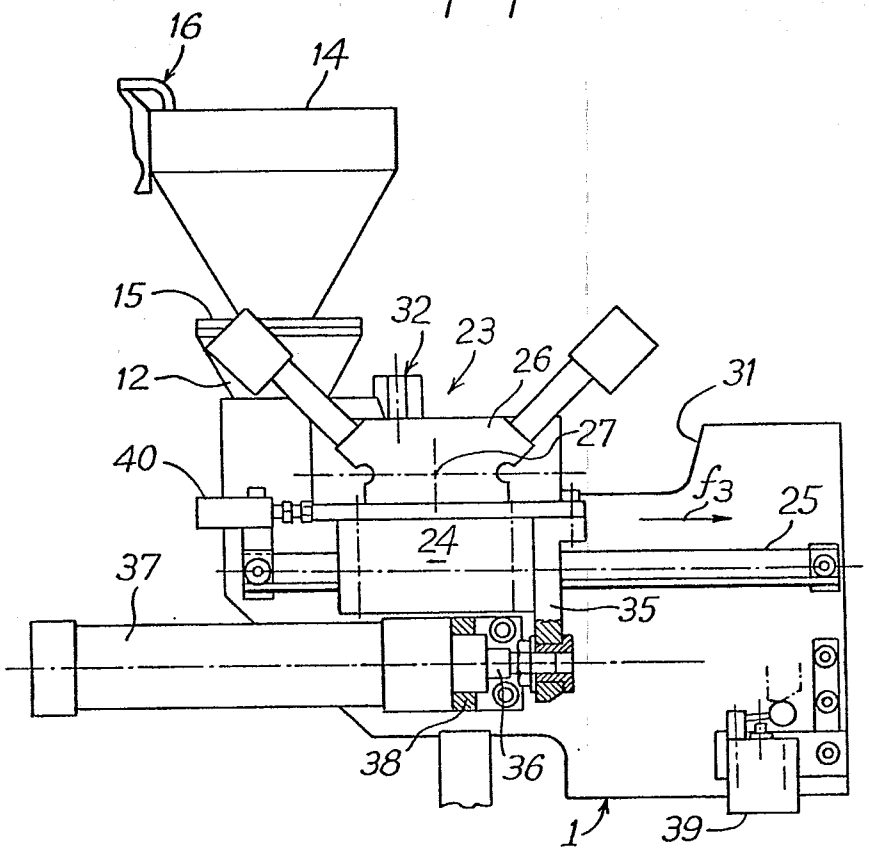
FIG. 3 is a side view, partly broken away, taken along line III—III of FIG. 2.
Figure 4:
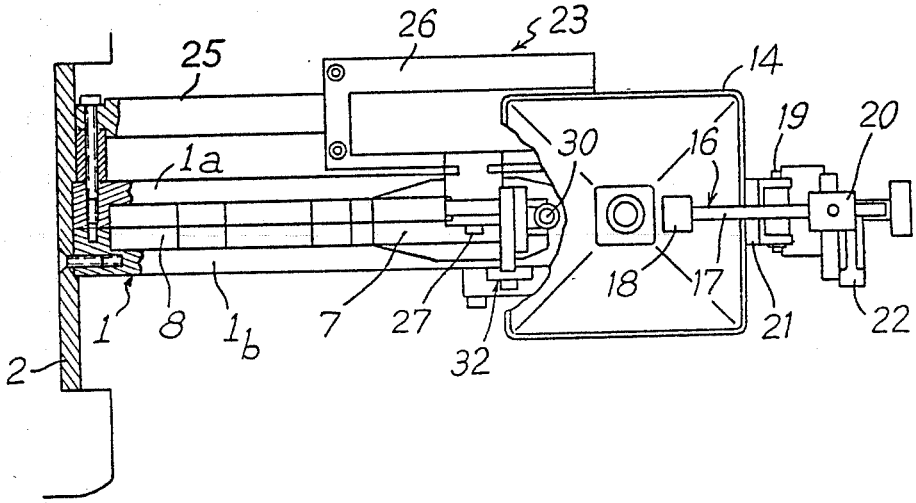

At this point, the power supply to jack 37 is reversed, driving the extension stroke of piston stem 36 and causing carriage 24 to move in the direction of arrow $f_3$ in FIG. 3, i.e. away from the hopper side of the device.

The ladle 30 is returned to a position in alignment with chamber 8, and is at first maintained in the same position within the chamber 8 as it had last reached in chamber 7.

In the course of moving from chamber 7 to chamber 8, in the direction of arrow $f_3$, the opening at the top of the ladle 30 wipes against blade 33 which smooths, without compressing, the measured quantity or dose of powder picked up by ladle 30. The dose of product is thus strictly limited to the useful volume offered and filled by the ladle 30. Moreover, the small surplus of powder is discharged into the remaining mass of product in chamber 7 thus avoiding any contamination of the surrounding area.

At the end of the extension stroke, the end plate 35 trips limit switch 39 which reverses the power supply to the rotary actuator 26. Consequently, shaft 27 is rotatively driven in reverse, in the sense opposite the sense of arrow $f_2$, and returns the ladle 30 to its original position illustrated by the broken line drawing in FIG. 1. This reverse angular motion of the ladle 30 results in emptying of the contents into chamber 8 as a result of which the contents can flow by gravity in a substantially direct manner due to the very shape of said chamber 8. It should be pointed out at this time that the sloping walls of the discharge chamber 8 are purposely selected to retain as little of the powdered product as possible when guiding the delivered dose toward the receiver 53 in cup 52.

The measured dose of powder is delivered into receiver 53, which is closed and which can retain the product as long as the overall system operating cycle, slaved to the appearance of a container 3 in the desired loading or filling position, has not been enabled by the validation of this appearance. When the second part of the cycle is enabled, the cylinder 47 is powered to drive the extension stroke of piston rod 48, taking the cup 52 from its loading position to its discharging position, the latter position wherein it is at least partly inserted into the mouth of filler funnel 42, as depicted in FIG. 1.

The extension stroke of piston rod 48 in the direction of arrow $f_4$ away from the hopper, results in the positioning of the cover 61 in front of the outlet of chamber 8 or of the passage 44. The cover plate 61 protects the cylindrical guide rods 50 and the piston rod 48 against spillage of one or more particles of powdered product.

Toward the end of the extension stroke of rod 48, backstop 59 hits guide sleeve 58, preventing the free sliding of push rod 57. The continued motion of cup 52 in the direction of arrow $f_4$, away from the hopper (FIG. 1), at this time causes automatic positive opening of the hinged shutter 54 just as the cup 52 is engaged in funnel 42 such that the outlet of receiver 53 is located within the internal envelope of funnel 42. This has the effect of discharging the dose of powder which is thus dropped into the funnel 42 leading it to the inside of the container 3.

It should be emphasized that the discharging of the dose of powder from receiver 53 is also produced by the shock resulting from the impact between the backstop 59 and the guide sleeve 58, the impact shock being transmitted to the cup 52 through the structural frame of the dispenser 41. The discharge further results from a delayed shock wave resulting from the impact between the stops 50*a* and the bracket 46 which promotes the loosening of any particles still sticking to the walls of the cup.

Complete discharge of the dose of powder is assured due to the shape of the receiver 53, whose walls are all either vertical or steeply sloped and are provided with a polished surface, as the walls of both chamber 8 and passage 44.

At the end of the extension stroke of rod 48, the slide 49 can actuate, by means of a finger 62, an additional limit switch 63, triggering the reversing of the power supply to cylinder 47. The piston rod 48, in retracting, draws the cup 42 opposite the direction of arrow $f_4$, and toward the initial position beneath and in line with discharge chamber 8. Backstop 59 separates from guide 58, causing the spring 60 to return the shutter 54 automatically to closed position.

The dispenser's 41 return to starting position can be detected by means of a second additional limit switch 64 actuated by said finger 62 to enable starting of another cycle like the one just described.

It should be clear from the foregoing description that the proportioning dispenser according to the invention is in fact a compact unit which can be easily mounted on or disassembled from a work station by suitable fitting to a plate or panel 2 from which it cantilevers out and over a work area or transfer station along which pass a series of containers 3 having to be filled with a given quantity of powered product.

The invention further provides a device wherein the various receiver or storage capacities, chambers or cells used to temporarily contain the product are sufficiently isolated from one another during the operating cycle to prevent the spread of a fire or explosion. In fact, the ridge $1_1$ is deliberately shaped to prevent a fire or explosion affecting powdered product retained at the bottom of the discharge chamber 8 from spreading to the product load in chamber 7.

Similarly, cover 61 serves as a fire wall preventing the spread of a fire from the funnel 42 up and to chamber 7 when the cup 52 is in discharge position.

The shutter 54 plays the same role of a fire wall with respect to the dose of powder downloaded into receiver 53 when aligned with discharge chamber 8.

The proportioning dispenser according to the invention can be automatically cycled for as long as the hopper 14 contains enough powder to ensure automatic feeding of chamber 7. As soon as the supply of powder falls below a set point determined by the setting of level sensor 16, switch 22 trips a warning device calling for manual refilling of the hopper 14 or trips an automatic refill.

FIG. 7 depicts a sensor for detecting the passage of powdered product through the base of chamber 8. The detector has a swivel arm 65 fitted to a shaft 66 supported by the main body 1. The arm is provided with a pallet 67 extending beyond the arm, permanently into chamber 8 after projecting through a window 71 provided in the wall of body 1. The end of the swivel arm opposite the pallet can be fitted with a counterweight 68. The latter end cooperates with a flow or passage sensor 69 of any suitable type installed in a housing 70 sealingly fitted to body 1. In the case of an application involving an explosive powder, said sensor 69 consists of a fluidic system which sends a jet of fluid under pressure toward a transducer in the field whereof is placed the end of the swivel arm in a state of balance, as illustrated by the solid line drawing of the arm.

Each measured quantity of product delivered influences the swivel arm, sending it into the temporary configuration depicted with broken lines. The sensor's operation validates the delivery of a dose by ladle 30. On the other hand, failure to operate within a specified amount of time indicates a malfunctioning of the rotary proportioner 23.

While particular embodiments of this invention have been disclosed herein, it will be understood that various modifications may be made without departing from the spirit and scope of the invention as defined by the following claims.

What is claimed is:

1. A proportioning dispenser for powdered products, comprising:

a main attaching and supporting body defining a filling chamber and a discharge chamber separated from one another by a ridge;

a feed hopper supplying powdered product to said filling chamber;

a proportioner operable to move cyclically between said filing chamber wherein it picks up a load of powdered product and said discharge chamber whereinto it dumps said load, said proportioner including a ladle mounted on a horizontal shaft of a rotary actuator, said rotary actuator being mounted on a carriage sliding on a slideway affixed to the outside of said main body and parallel thereto and connected to a reciprocating jack, said ladle being carried by said shaft and rotatably driven thereby alternatively within said discharge chamber and within said filling chamber, said filling chamber being provided with an adjustable blade for wiping off excess product from the loaded ladle top; and a dispenser located beneath said discharge chamber and comprising a cup and means for moving said cup cyclically from a loading position vertically aligned with said discharge chamber and a discharge position vertically non-aligned with said discharge chamber.

2. A proportioning device for powdered products, comprising:

a main attaching and supporting body defining a filling chamber and a discharge chamber; said filling chamber having an overall cylindrical shape defined about a horizontal axis and having an opening at the top of said body; said discharge chamber having an inverted truncated conical shape with a large base and a small base, said large base opening at the top of said body, said small base opening through the bottom of said body, said discharge chamber being located laterally of said filling chamber and being separated from said filling chamber by a ridge;

a feed hopper coupled to said body by a funnel seat supported by the top of said body for supplying powdered product to said filling chamber, a tangential connecting pipe coupling said feed hopper to said filling chamber;

a proportioner including a rotatable ladle and a cooperating wiper blade for removing excess powder from said rotatable ladle and means for moving said ladle between said filling chamber where it picks up a load of powdered product and said discharge chamber whereinto it dumps said load; and a dispenser located beneath said discharge chamber and comprising a cup and means for moving said cup cyclically from a loading position vertically aligned with said discharge chamber and a discharge position vertically non-aligned with said discharge chamber.

3. A proportioning dispenser as in claim 2, wherein the ridge rises above the horizontal plane passing through the bottom of said filling chamber.

4. A proportioning dispenser, comprising:

(A) a filling chamber for holding a large quantity of powdered material for which small quantities of powdered material are to be dispensed;

(B) a discharge chamber located laterally of said filling chamber;

(C) proportioner means for obtaining a predetermined quantity of powdered material from said filling chamber and for dispensing said predetermined quantity of material into said discharge chamber, said proportioner comprising:

(1) a ladle having a measuring cup whose volume, as measured below a lip of said cup, is equal to said predetermined quantity;

(2) means for rotatably passing said cup through said powdered material in such a manner that powdered material fills said cup and extends over the lip of said cup, said material extending over said lip representing excess material to be removed;

(3) moving means for moving said cup from a first position over said filling chamber to a second position over said discharge chamber after said cup has been filled with said material; and (4) a blade located above said filling chamber and cooperating with said lip of said cup to remove said excess quantity of material from said cup as said cup is moved from said first to said second position whereby said excess material is removed from said cup and returned to said filling chamber.

5. A proportioning dispenser according to claim 4, wherein said means for passing said cup through said powdered material comprises rotary means for pivoting said ladle about a horizontal axis located above said filling chamber and wherein said moving means moves said ladle horizontally in a direction perpendicular to said axis.

6. A proportioning dispenser according to claim 5, further including a feed hopper for supplying powdered material to said filling chamber.

7. A proportioning dispenser according to claim 6, further including a dispenser located below said discharge chamber and receiving powdered material passing through said discharge chamber and means for moving said dispenser between a loading position vertically aligned with an opening in the bottom of said discharge chamber and a discharge position vertically non-aligned with said opening at the bottom of said discharge chamber.

8. A proportioning dispenser for powdered products, comprising:

a main attaching and supporting body defining a filling chamber and a discharge chamber separated from one another by a ridge;

a feed hopper supplying powdered product to said filling chamber;

a proportioner operable to move cyclically between said filling chamber wherein it picks up a load of powdered product and said discharge chamber whereinto it dumps said load; and a dispenser located beneath said discharge chamber and comprising a cup carried by a slide mounted on guide rods and driven back and forth between first and second positions by a cylinder, said cup being located in a loading position vertically aligned with said discharge chamber when said slide is in said first position, said cup being a discharge position vertically non-aligned with said discharge chamber when said slide is in said second position, said cup defining a receiver capacity, one of the walls of said cup including a horizontally hinged shutter connected to a push rod mechanism operable to automatically open and close the shutter synchronously with the movement of said slide between said first and second positions.

9. A proportioning dispenser as claim 8, wherein said dispenser is associated with a cover fitted to a top of the slide frame, operable to seal off the outlet from the discharge chamber when the dispenser cup is in said discharging position.

10. A proportioning dispenser as in claim 8, said body being provided with flow sensing means to signal when a dose of powdered product has effectively passed through said discharge chamber.

11. A proportioning dispenser as in claim 8, wherein said shutter is associated with a mechanism providing spring-actuated closure and positive opening of said shutter when said cup is in said second position.

12. A proportioning dispenser as in claim 11, wherein said cup is provided with a front-mounted shutter as seen from a receiving means into which it unloads.

13. A proportioning dispenser for powdered products, comprising:

a body defining a filling chamber having an open top and a discharge chamber having an open top and an open bottom; said filling and discharge chambers being laterally spaced from one another; said filling chamber communicating with the bottom of a funnel seat supported by the top of said body and supporting a feed hopper via a tangential connecting pipe;

a proportioner including: a ladle which is rotatable about a horizontally extending axle, means for horizontally translating said axle in a manner which moves said ladle between a first position wherein said ladel is located above said filling chamber and a second position wherein said ladel is located above said discharge chamber and means for rotating said ladle about said axle when said ladle is in said first position in such a manner that said ladle picks up a load of powder from a supply of powder located in said filling chamber and for rotating said ladle about said axle when said ladle is located in said second position in such a manner that said ladle dumps said load of powder into said dispensing chamber;

a blade located above said filling chamber for removing excess powder from said ladle as said ladle is moved between said first and second positions; and said body supporting a dispenser located below said open bottom of said discharge chamber and comprising a cup operable to be cyclically moved between a loading position vertically aligned with said open bottom of said discharge chamber and a discharge position in which said cup is out of vertical alignment with said open bottom of said discharge chamber.

14. A proportioning dispenser according to claim 13, wherein said filling chamber has a generally cylindrical shape whose axis is parallel to said axle and said discharge chamber has a generally inverted truncated conical shape having a large base and a small base, said large base defining said open top of said discharge chamber, said small base defining said open bottom of said discharge chamber, and wherein a ridge is formed in said body between said filling and discharge chambers.

15. A proportioning dispenser according to claim 13, wherein said axle is defined by a horizontal shaft of a rotary actuator, said rotary actuator being mounted on a carriage sliding on a slideway affixed to the outside of said main body and parallel thereto and connected to a reciprocating jack, said ladle being carried by said shaft and rotatably driven thereby alternately within said discharge chamber and within said filling chamber.

16. A proportioning dispenser according to claim 13, wherein said discharge chamber is provided with sensing means for detecting the movement of powder through said discharge chamber, said sensing means including a swivel arm coupled to a shaft supported by said body, said arm being provided at one end thereof with a pallet located in said discharge chamber, said arm having its second end cooperating with a fluidic sensor to indicate the movement of powder material through said dispensing chamber.

17. A proportioning dispenser according to claim 13, wherein said dispenser comprises a cup carried by a slide mounted on guide rods and driven back and forth between a first position wherein said cup is located in said loading position and a second position wherein said cup is located in said discharge position by a cylinder, said cup defining a receiver capacity, one of the walls of said cup including a horizontally hinged shutter connected to a push rod mechanism operable to automatically open and close said shutter synchronously with the back and forth motion of said slide.

18. A proportioning dispenser according to claim 17, wherein said slide supports a cover which is movable with said slide and which closes said open bottom of said discharge chamber when said cup is moved into said discharge position.

19. A proportioning dispenser according to claim 17, wherein said shutter is associated with a mechanism providing a spring-actuated closure and a positive opening of said shutter when said cup is in said discharge position.

20. A proportioning dispenser according to claim 19, wherein said cup is provided with a front-mounted shutter as seen from a receiving means into which it unloads.

* * * * *